US005244164A

United States Patent [19]

Gacsay

[11] Patent Number: 5,244,164

[45] Date of Patent: Sep. 14, 1993

[54] YARN BRAKE HAVING AN ELECTROMAGNETICALLY OPERATED BRAKE LAMELLA

[75] Inventor: Lorant Gacsay, Zurich, Switzerland

[73] Assignee: Sulzer Brothers Limited, Winterthur, Switzerland

[21] Appl. No.: 830,316

[22] Filed: Jan. 31, 1992

[30] Foreign Application Priority Data

Feb. 6, 1991 [CH] Switzerland ..... 368/91

[51] Int. Cl.[5] ..... B65H 59/22

[52] U.S. Cl. ..... 242/149; 139/450; 242/150 M

[58] Field of Search ..... 242/149, 150 M, 147 M; 139/450, 194

[56] References Cited

U.S. PATENT DOCUMENTS

| | | | |
|---|---|---|---|
| 2,907,535 | 10/1959 | Mindheim et al. | 242/150 M |
| 3,100,091 | 8/1963 | Mindheim et al. | 242/150 M |
| 3,633,711 | 1/1972 | Pfarrwaller | 242/149 X |
| 4,112,561 | 9/1978 | Norris . | |
| 4,313,578 | 2/1982 | Van Wilson | 242/149 |
| 4,641,688 | 2/1987 | Gehring | 242/149 X |
| 4,875,506 | 10/1989 | Gacsay et al. | 242/150 M X |
| 5,002,098 | 3/1991 | Desmet et al. | 139/450 X |

FOREIGN PATENT DOCUMENTS 2597889 10/1987 France .

*Primary Examiner*—Stanley N. Gilreath
*Attorney, Agent, or Firm*—Kenyon & Kenyon

[57] ABSTRACT

The yarn brake (1) having electromagnets (12, 12') and a brake lamella (2) has, on that side thereof that is remote from the yarn (3), a segmented layer (5) of soft ferromagnetic material. The layer (5) is effective to strengthen the magnetic attraction. Substantially plate-like segments (55, 56) of the layer (5) are disposed in accordance with the operating ranges of the discrete electromagnets (12, 12') and have connections (60, 560) to one another and/or to the brake lamella (2). The connections (60) between the segments (55) are flexible. Because of the segmentation of the attraction-increasing segmented layer (5), the flexibility of the brake lamella (2) remains substantially unimpaired. The yarn brake can be released by electromagnets (12') disposed on one side of the segmented layer (5). By means of a blower (28) having nozzles (29) distributed over the length of the brake gap, fly can be removed from the braking surfaces when the yarn brake (1) is released periodically.

10 Claims, 3 Drawing Sheets

FIG. 1a
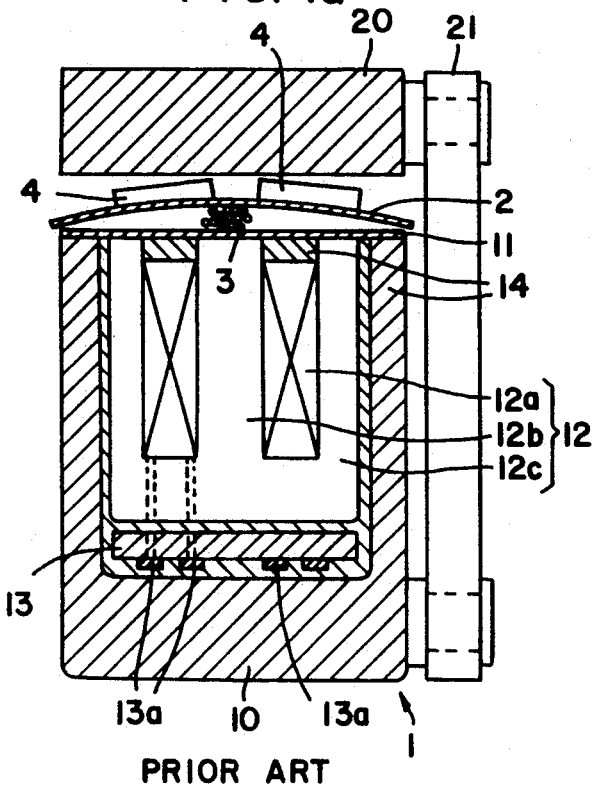
PRIOR ART
FIG. 1b
PRIOR ART
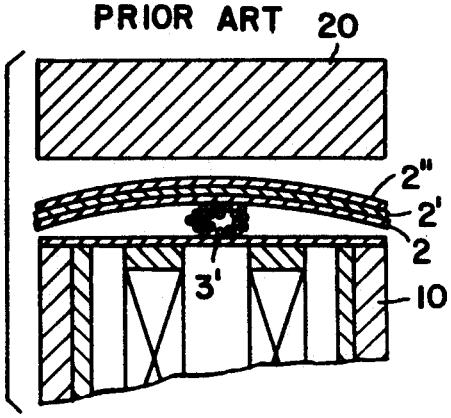
PRIOR ART
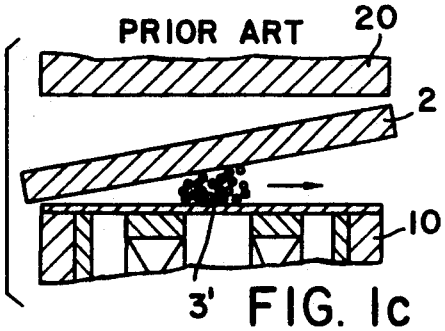
FIG. 1c
FIG. 2a
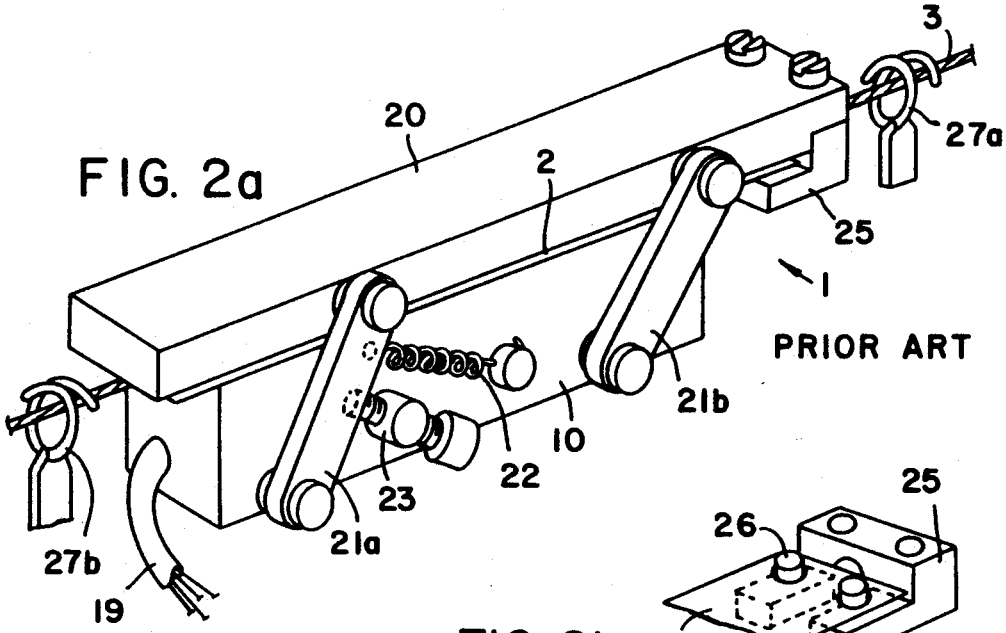
PRIOR ART
FIG. 2b
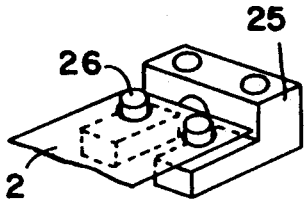
PRIOR ART Fig. 3
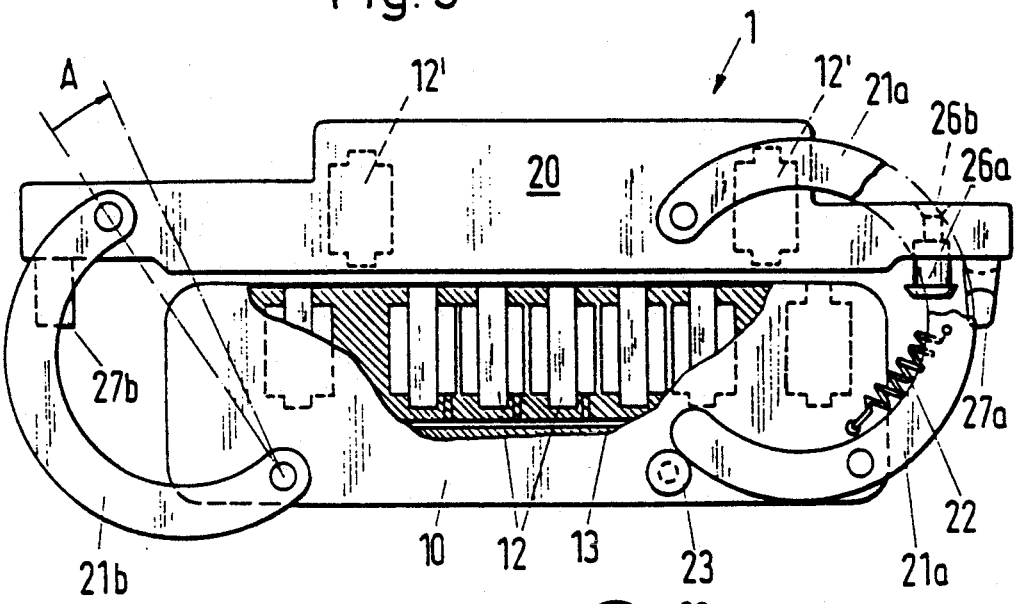
Fig. 4a
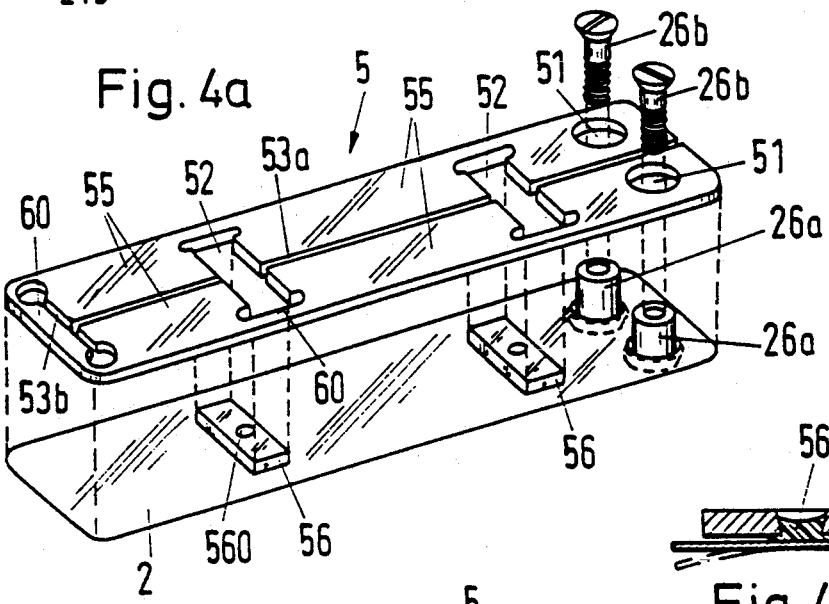
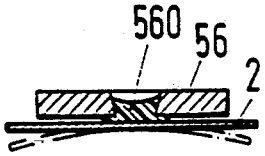
Fig. 4b
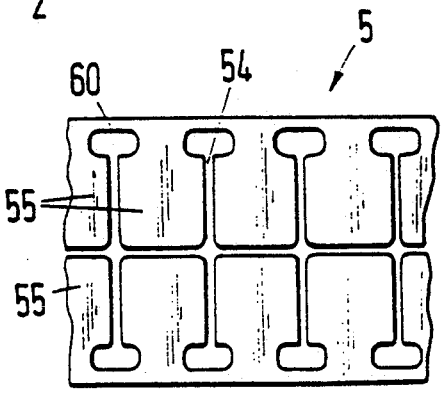
Fig. 5

YARN BRAKE HAVING AN ELECTROMAGNETICALLY OPERATED BRAKE LAMELLA

FIELD OF THE INVENTION

This invention relates generally to yarn brakes and to looms having such brakes and, more particularly, to yarn brakes having an electromagnetically operated brake lamella.

BACKGROUND INFORMATION

EP-A 0 294 323 discloses a yarn brake wherein the yarn is guided between a rigid braking surface (the top of the bottom brake member) and a flexible lamella movable by electromagnets. The lamella is in the form of a thin ferromagnetic metal band or strip or the like. It is of reduced mass and therefore reacts rapidly in an advantageous manner to brief on-times of the electromagnets. Since the lamella is thin, a number of electromagnets are required and experience indicates that at least five are needed; they are disposed in a row in the direction of yarn movement below the rigid braking surface. This has the further advantage that braking occurs at a number of places with relatively reduced surface pressures and therefore in a manner not damaging the yarn. A disadvantage, on the other hand, is that this yarn brake is a relatively long construction and therefore takes up considerable space as compared with other known yarn brakes, in which the yarn is clamped in spots at just one or possibly two places. If the magnets are arranged differently, for example, in a double row, yarn brake length can be reduced, but at the cost of increased yarn brake width.

It has been found in practice that the known yarn brake having an electromagnetically operated brake lamella has a further disadvantage, in that fly evolved from the yarn accumulates on the braking surfaces, more particularly on the longitudinal edges of the lamella. Of course, the adhering fibers enlarge the brake gap or clearance. Since the braking force decreases rapidly with increasing clearance, braking is greatly impaired by the fly deposits. It is therefore necessary to remove the disturbing fibers either continuously or intermittently. This requirement leads to a possibility of releasing the brake far enough for the fibers to be cleared readily from the brake gap, for example, by blowing or sucking.

As is already known, (EP-A 0 294 323) to facilitate release of the brake, individual electromagnets (also called magnet windings) are devised as release windings. In this case, laminar permanent magnets are provided on the brake lamella opposite the release windings and on the side remote from the yarn. With the braking magnets off and if the release windings are polarised appropriately, the brake lamella can be completely disengaged—i.e., the yarn brake can be released. However, the additional use of release windings entails the disadvantage that the yarn brake takes up even more space.

Other disadvantages concern yarn thickness. In the case of very thin yarns, residual magnetism causes the brake lamella to stick to the bottom brake member and in picking mechanisms the lamella then produces detrimental tensions in the weft yarn at the start of a pick. The disadvantage can be obviated by the possibility of opening the brake gap by means of release windings. A problem with thick yarns is that the brake gap is relatively wide and so the magnetic braking forces are relatively weak. This disadvantage can be obviated by force amplification—i.e., by using instead of just a single brake lamella a number of ferromagnetic lamellae disposed one above another.

It is the object of the invention to provide for the yarn brake hereinbefore described for providing force amplification for both the braking and the release electromagnets, improvements being made with respect to the disadvantages mentioned with particular emphasis on minimum impairment of lamella flexibility.

To amplify the braking force and the release force according to the invention, soft ferromagnetic metal laminae are disposed between the brake lamella and the brake cover. The laminae form a segmented layer. The discrete segments, arranged in accordance with the operative zones of the electromagnets, are interconnected; however, the connections between them must be flexible so that the flexibility of the segmented layer corresponds to the flexibility of the brake lamella. The segments can also be connected thereto, in which case the contact zones providing the connections should be very small to ensure minimum impairment of lamella flexibility. At least individual segments must be connected to the lamella so that when electromagnets in the brake cover act to produce a release of the brake, the lamella is compelled to disengage from the bottom braking surface.

SUMMARY OF THE INVENTION

The present invention is directed to a yarn brake having an electromagnetically operated brake lamella. The yarn brake includes a brake body having a rigid braking surface, a brake cover and a flexible brake lamella disposed between the brake body and the brake cover. A plurality of braking electromagnets are disposed in the brake body for engaging the brake lamella with the braking surface. A plurality of release electromagnets are disposed in the brake cover for disengaging the brake lamella from the braking surface. A segmented layer of soft ferromagnetic material comprising a plurality of segments is disposed between the brake lamella and the brake cover. The segments are each positioned such that they correspond to the operative ranges of the braking electromagnets and the release electromagnets.

BRIEF DESCRIPTION OF THE DRAWINGS

The invention will be described in greater detail hereinafter with reference to the following drawings, wherein:

FIG. 1*a* is a cross-section through a known yarn brake;

FIG. 1*b* is a partial cross-section through a known yarn brake, in which force amplification is provided by means of additional lamellae;

FIG. 1*c* is a cross-section through a yarn brake having a thick and less flexible brake lamella;

FIG. 2*a* is a perspective view of a known yarn brake;

FIG. 2*b* is a perspective view of a mounting for the brake lamella;

FIG. 3 is a side elevation of a yarn brake according to the invention without a brake lamella and without force-amplifying elements;

FIG. 4*a* is an exploded view showing a brake lamella having a segmented layer according to the invention;

FIG. 4*b* is a cross-section view of a detail for the attachment of a segment to the brake lamella;

FIG. 5 is a plan view of part of a segmented layer embodied by thin elements:

DETAILED DESCRIPTION

Figure 6A:
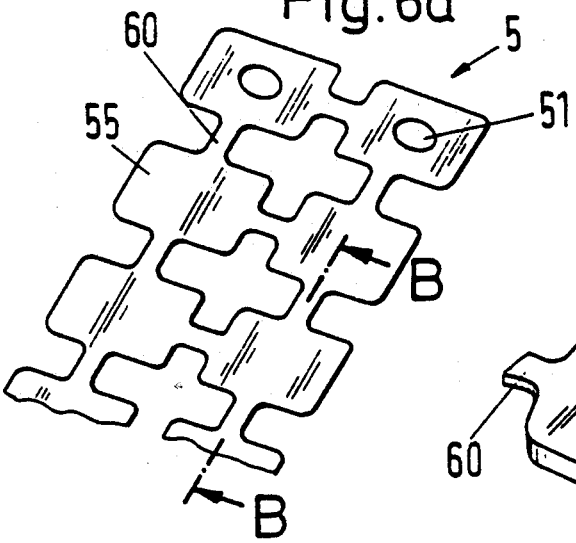
FIG. 6*a* is a perspective view of a second embodiment of a segmented layer embodied by thin elements.

The prior art will be discussed in some detail with reference to FIGS. 1*a* to 2*b* in order to explain what is known as it concerns force amplification of the braking and/or release magnets. In FIG. 1*a* the following components of yarn brake 1 can be seen: a brake member 10, a brake cover 20 and, disposed therebetween, a brake lamella 2, which in co-operation with a bottom braking surface 11, can clamp a filament or thread 3 shown in the form of a fiber yarn. Laminar permanent magnets 4 are attached to the lamella 2 and operate the brake for release. Electromagnets 12 each having a winding 12*a*, core 12*b* and yoke 12*c* are disposed on a support 13 via which the electrical connections are made. The electromagnets 12 with the support 13 are cast in the brake member 10 in a synthetic resin 14. The brake cover 20 is connected to the brake member 10 by way of pivotable links 21*a* and 21*b*.

In the case of thick yarn 3' as shown in FIG. 1*b*, a single brake lamella 2 having a thickness of 0.05 mm, a value advantageous for flexibility, is insufficient. For force amplifications, two additional lamellae 2', 2" are provided for example. A single but thicker lamella 2 having a thickness, for example, of 0.15 mm, of the kind shown in FIG. 1*c*, is unsuitable. It has either little or no flexibility and tilts to one side, with the risk of the yarn 3' being forced out of the brake laterally in the direction indicated by an arrow.

The perspective view of FIG. 2*a* shows the two links 21*a*, 21*b* which are pivotable together parallelogram-fashion and which enable the distance between the brake member 10 and the cover 20 to be varied and adjusted. A tension spring 22 pulls the link 21*a* towards the brake member 10 where it abuts an adjustable stop 23. The yarn 3 is guided through the brake 1 by means of an entry yarn guide 27*a* and an exit yarn guide 27*b*. The lamella 2 is just suspended on the input side on pins 26 on a mounting 25 (see also FIG. 2*b*). The electromagnets are activated by way of connecting wiring 19.

In connection with the force amplification of the electromagnets by means of additional ferromagnetic material between the lamella 2 and the cover 20, care must be taken to ensure that there is minimal impairment of lamella flexibility. At least two permanent magnets 4 instead of just one are used per release electromagnet in the manner shown in FIG. 1*a*. Soft ferromagnetic laminae can be used instead of the permanent magnets 4, but in this case the electromagnets must be disposed in the cover 20. Depending upon the pattern of these soft magnet laminae, a force amplification can be provided for the braking electromagnets. This consideration leads on to the subject of the invention.

FIG. 3 is a side elevation of a yarn brake 1, which has evolved from the yarn brake shown in FIG. 2*a*. The links 21*a*, 21*b* are arcuate to reduce fly accumulation between the brake gap and the links, fly accumulation being a feature of the known straight-link type yarn brake. An arrow A indicates the pivoting movement of the link 21*b*. A tension spring 22 and a stop 23, for example, an eccentric screw, are associated with the link 21*a*. The yarn guides 27*a*, 27*b* are attached to the ends of the cover 20.

The braking electromagnets 12 are disposed in a row in the brake member 10, which is shown partly cut open. In the embodiment illustrated, the electromagnets 12 form a five-magnet group flanked at each of its two ends by a space from a further magnet. Two release electromagnets 12' are disposed in the cover 20 opposite the latter spaces. The same can be narrower than the electromagnets 12. The yarn brake 1 is therefore in advantageous manner shorter than if the release electromagnets 12'—given the use of permanent magnets—were also to be disposed in the brake member 10. As previously stated, the electromagnets 12 can be arranged differently in a way reducing the length of the brake 1. A different arrangement may also improve matters concerning the action of the force on the lamella 2. Two mushroom-like pins 26*a* secured by screws 26*b* to the cover 20 are provided for the mounting of the lamella 2. FIG. 4*a* shows a first embodiment of a lamella 2 having a segmented layer 5 in accordance with the invention. The segments 56 associated with the release electromagnets 12' have attachment means 560, in the form, for example, of a conical aperture and an adhesive composition (see FIG. 4*b*), for connecting the segment 56 to the lamella 2. The means 560 are limited to a reduced contact area so that, as is required, there is only minimal impairment of lamella flexibility (see FIG. 4*b*, where the lamella 2 attracted by the electromagnet is shown in chain-dotted line).

The remainder of the segmented layer 5 comprises a thick lamella formed with apertures and slots. Recesses 52 are present for the segments 56. The segments 55, which are bounded by the slots 53*a*, 53*b* and by the recesses 52, are interconnected by webs 60, which are narrow and therefore permit flexibility of the layer 5. The two apertures 51 allow joint mounting with the lamella 2 in the brake 1.

FIG. 5 shows a part of a layer 5 according to the invention, such layer being segmented into thin elements. The discrete segments 55 are each associated with one half of an electromagnet 12. Such segments 55 can be used instead of the segments 56 of FIG. 4*a*. In this event at least individual segments 55 must be connected to the lamella 2, for example, by spot welds or by connections similar to the connection embodied by the means 560 of FIG. 4*b*. All the segments 55 are unitary with one another. Consequently, the segments secured to the lamella 2 need not necessarily be the segments associated with the release electromagnets.

Figure 6B:
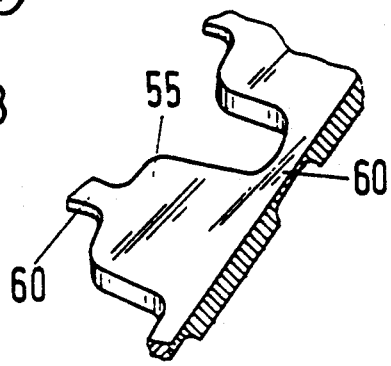
FIG. 6*b* is an enlarged view of the detail taken along section line B—B in a detail of FIG. 6*a;*

The layer 5 can be produced, for example, by etching. In a process of this kind an etching mask is produced on both sides of a metal strip by means of a photo-sensitive varnish and by exposure with the required pattern. The metal strip can then be etched through in an acid bath at the exposed places of the varnish layer that correspond to the apertures 54 in the segmented layer 5 (see FIG. 5). This process gives highly flexible shaping. FIG. 6*a* shows another example where the segment connections 60 are made thinner by unilateral etching (see FIG. 6*b*, which is a section along the line B—B of FIG. 6*a*). The connections between the segments 55 can be serpentine (not shown) for improved flexibility of the layer 5.

Problems associated with the attachment of the layer 5 in the brake are minimal when the segments form a coherent or unitary member. This should be borne in mind when devising the segmentation.

Figure 7A:
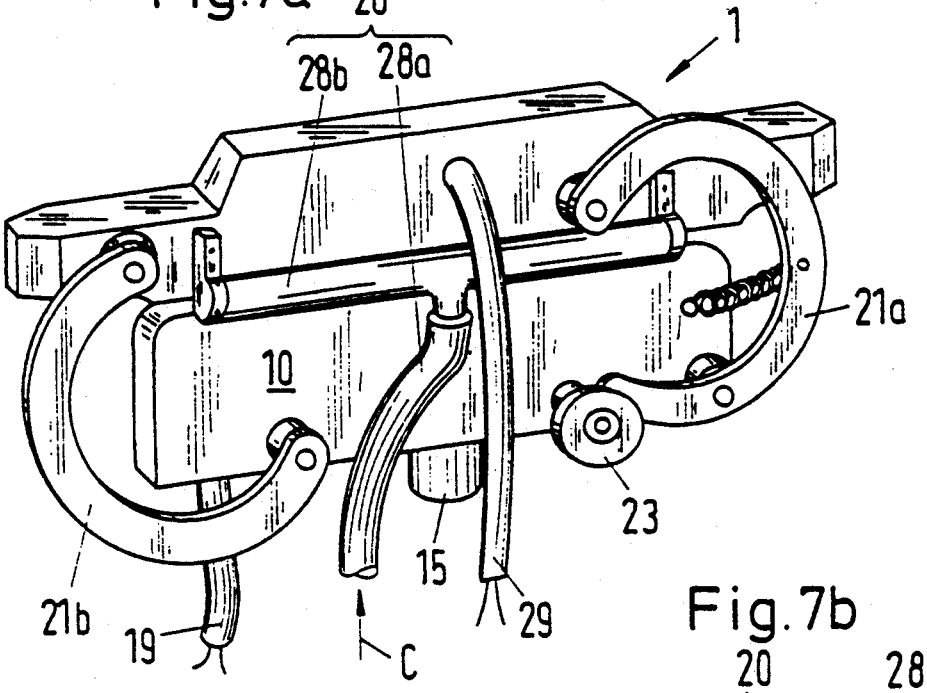
FIG. 7*a* is a perspective view of a yarn brake according to the invention with blowing means.
Figure 7B:
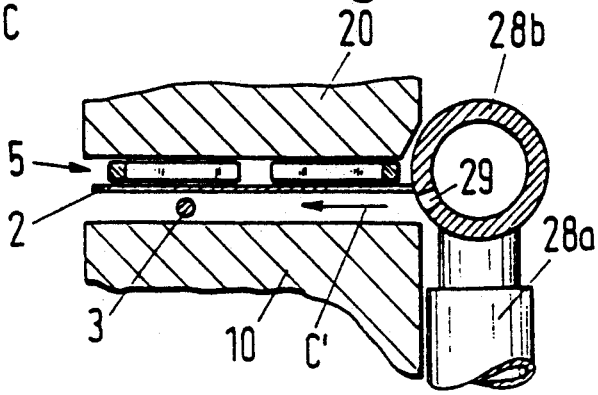
FIG. 7*b* is a view of a detail of FIG. 7*a* in cross-section through the brake gap.

The perspective view of FIG. *7a* shows a yarn brake 1 in accordance with the invention; as compared with FIG. 3 additional parts are shown, viz. connecting wiring 19 for the braking electromagnets, connecting wiring 29 for the release electromagnets, a brake carrier pin 15 and blowing means 28. The latter, together with a connecting line 28*a* for compressed air, indicated by an arrow C, and with a distributing tube 28*b* is effective to remove fly from the brake gap. The tube 28*b* has nozzles 29 distributed over brake gap length (see FIG. 7*b* in which the arrow C' indicates the airstream issuing from the nozzle 29). The blowing means 28 can be an integral component of the brake cover 20 or brake body 10.

The brake carrier pin 15 indicates that the brake body 10 is the bottom part of the yarn brake 1. However, this is not necessary and the brake could be turned, for example, through 180° or 90° relative to the direction of yarn movement.

So that a satisfactory braking force can be applied to the yarn, the brake lamella 2 is, with advantage, made of a ferromagnetic material. However, when the layer 5 according to the invention is used, the material used for the lamella 2 need not be ferromagnetic. In this event all that is necessary is for the layer 5 to be correspondingly thicker.

The yarn brake according to the invention is particularly suitable as a weft yarn brake between the yarn supply and the picking mechanism of shuttleless looms. A blower 28 for continuously removing accumulations of fly is very advantageous in such a case. The yarn brake according to the invention can also be used advantageously in yarn-processing machines having an intermittent yarn feed.

I claim:

1. A yarn brake, comprising:

a brake body having a rigid braking surface;

a brake cover having a side generally parallel to and facing said rigid braking surface;

a flexible brake lamella disposed between said brake body and said brake cover;

a plurality of braking electromagnets disposed in said brake body;

a plurality of release electromagnets disposed in said brake cover; and a segmented layer of soft ferromagnetic material comprising a plurality substantially laminar segments, said segmented layer being disposed between said brake lamella and said brake cover such that said segments are positioned to correspond to the operative ranges of said braking electromagnets and said release electromagnets, at least some of said segments being flexibly connected to each other and at least some of said segments being connected to said brake lamella.

2. The yarn brake of claim 1, wherein said segments connected to said brake lamella correspond to said release electromagnets.

3. The yarn brake of claim 2, wherein said segments connected to said brake lamella are discrete with respect to other segments of said segmented layer.

4. The yarn brake of claim 1, further comprising a mounting for said brake lamella and wherein said segmented layer is secured to said mounting.

5. The yarn brake of claim 1, wherein said segmented layer comprises a metal strip having apertures extending therethrough.

6. The yarn brake of claim 5, wherein said segments are integral with each other.

7. The yarn brake of claim 1, wherein said brake body is disposed below said brake cover.

8. The yarn brake of claim 1, wherein each of said segments corresponds to only one of said braking electromagnets and said release electromagnets.

9. The yarn brake of claim 1, wherein said segments connected to said brake lamella are connected such that the connection contact area between each segment and said brake lamella is less than the plan area of said segment.

10. The yarn brake of claim 1, wherein said rigid braking surface and said brake lamella define a brake gap therebetween and further comprising a blower having fly-removing nozzles distributed over the length of said brake gap.

* * * * *